US007560000B2

(12) United States Patent
Suzuki et al.

(10) Patent No.: US 7,560,000 B2
(45) Date of Patent: Jul. 14, 2009

(54) TITANIUM ALLOY PART AND METHOD FOR PRODUCING THE SAME

(75) Inventors: Takaharu Suzuki, Shizuoka (JP); Shuhei Adachi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 280 days.

(21) Appl. No.: 10/564,425

(22) PCT Filed: Jun. 3, 2005

(86) PCT No.: PCT/JP2005/010639

§ 371 (c)(1),
(2), (4) Date: Jan. 11, 2006

(87) PCT Pub. No.: WO2005/121387

PCT Pub. Date: Dec. 22, 2005

(65) Prior Publication Data

US 2006/0219337 A1 Oct. 5, 2006

(30) Foreign Application Priority Data

Jun. 10, 2004 (JP) ..... 2004-172183

(51) Int. Cl.
*C22F 1/18* (2006.01)

(52) U.S. Cl. ..... 148/421; 148/670; 148/671

(58) Field of Classification Search ..... None
See application file for complete search history.

(56) References Cited

U.S. PATENT DOCUMENTS 3,073,022 A * 1/1963 Bush et al. ..... 72/53
4,287,740 A 9/1981 Kumar
4,426,867 A * 1/1984 Neal et al. ..... 72/53
5,704,239 A * 1/1998 Beals et al. ..... 72/53
6,224,686 B1 * 5/2001 Aoki et al. ..... 148/230
6,267,558 B1 7/2001 Dingwell et al.

FOREIGN PATENT DOCUMENTS

| | | |
|---|---|---|
| DE | 195 17 275 A1 | 11/1996 |
| JP | 61-170551 | 8/1986 |
| JP | 05-112857 | 5/1993 |
| JP | 05-195175 | 8/1993 |
| JP | 07-041806 | 2/1995 |
| JP | 2906068 | 4/1999 |

OTHER PUBLICATIONS

English translation of Toshino, JP 61-170551.*

L. Wagner, Mechanical surface treatments on titanium, aluminum, and magnesium alloys. Materials Science and Engineering A263 (1999), p. 210-216.*

(Continued)

*Primary Examiner*—George Wyszomierski
*Assistant Examiner*—Mark L Shevin
(74) *Attorney, Agent, or Firm*—Keating & Bennett, LLP

(57) ABSTRACT

A titanium alloy part has a compressive stress of approximately 270 MPa or more within a depth of about 100 μm from a surface thereof. Since a large compressive stress exists in the area of the surface, the titanium alloy part exhibits a high fatigue strength.

8 Claims, 6 Drawing Sheets

OTHER PUBLICATIONS

Gerd Lutjering and James C. Willaims, Titanium, Springer-Verlag, 2003, Section 1.5, Chapter 1 "Introduction", p. 8-11 and Section 3.7, Chapter 3, "Surface Treatment", p. 113-122.*

Wagner, "Mechanical Surface Treatments on Titanium, Aluminum and Magnesium Alloys," Materials Science & Engineering, 1999, Germany.

* cited by examiner

TITANIUM ALLOY PART AND METHOD FOR PRODUCING THE SAME

BACKGROUND OF THE INVENTION

1. Field of the Invention

The present invention relates to a titanium alloy part such as a titanium alloy spring, and a method for producing the same.

2. Description of the Related Art

As compared to iron, titanium excels in physical properties which are important to any structural or functional part (or member) of a mechanical apparatus. Specifically, titanium has a lower density than that of iron, and has high strengths (e.g., tensile strength) relative to its specific gravity. Moreover, titanium has a Young's modulus which is about half of that of iron, and thus shows excellent elastic characteristics. Therefore, a structural or functional part which has a light weight, a high strength, and a good elasticity can be formed from titanium. A titanium alloy which is composed by adding various elements to titanium can have further improved characteristics.

In spite of such advantages, structural or functional parts composed of titanium or titanium alloys have only been used for specific applications such as aircraft or golf club shafts. The reason is that, conventionally, titanium and titanium alloys can only be produced at a higher cost than that of iron.

In recent years, however, methods for producing titanium alloys at lower costs have been developed, so that cost-related constraints on using titanium alloys as structural or functional parts are being relaxed. Therefore, studies have been directed to using titanium alloys in products in various fields by taking advantage of the aforementioned superior characteristics of titanium.

In particular, when a spring is composed of a titanium alloy (hereinafter, such a spring will be referred to as a "titanium alloy spring"), the weight per unit length of wire material composing the spring can be reduced due to the low density of titanium. The small Young's modulus makes it possible to reduce the number of turns made in the spring, and reduce the spring height and the total length of the wire material for the spring which are necessary for obtaining a given amount of contraction and expansion. Therefore, a titanium alloy spring can have a weight which is reduced by about 60% from that of a steel spring which has similar levels of functionalities. By using such light-weight springs for suspensions of a vehicle, the total weight of the vehicle can be reduced, and vibrations can be dampened quickly, whereby the vehicle running properties can be enhanced.

Conventionally, when producing a steel spring, objects (called "shot medium") such as cut wires of steel or cast steel balls are shot against the surface of the spring to cause plastic deformation of the surface, thus creating a compressive stress in the interior of the spring near the surface, whereby the durability of the spring is improved. This treatment is called "shot peening". In the case where a compressive stress has been created near the surface of the spring, even if a flaw is formed in the surface, the compressive stress will act in a direction which does not allow the flaw to expand. As a result, the flaw is prevented from expanding and causing destruction of the spring.

Also when producing a spring composed of a titanium alloy, shot peening is known to realize an improved durability, as is disclosed in Japanese Laid-Open Patent Publication No. 5-195175 and Japanese Laid-Open Patent Publication No. 5-112857.

However, a study conducted by the inventors of the present invention has shown that the shot peening conditions which are disclosed in the aforementioned publications do not actually guarantee that a spring having a sufficient durability, especially a sufficient fatigue strength, will be obtained.

SUMMARY OF THE INVENTION

In order to overcome the problems described above, preferred embodiments of the present invention provide a titanium alloy part having an excellent durability, and a method for producing the same.

A titanium alloy part according to a preferred embodiment of the present invention has a compressive stress of approximately 270 MPa or more within a depth of about 100 μm from a surface thereof. Herein, the compressive stress is a measurement result of residual stress by an X-ray technique using a V tube.

In a preferred embodiment, the titanium alloy part includes a surface region extending from the surface to a depth of about 100 μm, and an internal region located internal relative to the surface region, wherein the surface region includes a modified layer containing more a phase than does the internal region, the modified layer accounting for a proportion of about 10 vol % or less of the surface region.

In a preferred embodiment, the surface has a maximum surface roughness Rt of about 20 μm or less.

In a preferred embodiment, the titanium alloy part contains about 50 vol % or more of β phase at room temperature.

In a preferred embodiment, the titanium alloy part is a spring.

In a preferred embodiment, the titanium alloy part is a suspension spring for a vehicle.

In a preferred embodiment, the titanium alloy part is one selected from the group consisting of a valve spring for an engine, a connecting rod for an engine, and a structural part for an aircraft.

An engine according to a preferred embodiment of the present invention includes a titanium alloy part having the aforementioned configuration.

A vehicle according to a preferred embodiment of the present invention includes a titanium alloy part having the aforementioned configuration.

A method for producing a titanium alloy part according to another preferred embodiment of the present invention includes a step (A) of providing a shaped titanium alloy part, a step (B) of subjecting the shaped titanium alloy part to a shot peening using a first shot medium, and a step (C) of mechanically or physically removing at least a part of a modified layer created in a surface region of the shaped titanium alloy part as a result of step (B).

In a preferred embodiment, step (C) includes shooting a second shot medium against a surface of the shaped titanium alloy part, the second shot medium having a higher hardness than that of the first shot medium.

In a preferred embodiment, the second shot medium has a Vickers hardness of about 1,000 or more.

In a preferred embodiment, the second shot medium contains $SiO_2$.

In a preferred embodiment, step (C) removes the shaped titanium alloy part at a depth of about 20 μm to about 40 μm from the surface.

In a preferred embodiment, the shaped titanium alloy part has a Vickers hardness of about 370 to about 470.

In a preferred embodiment, step (A) includes a step (A1) of winding around a wire material of a titanium alloy to obtain a shaped titanium alloy part having a coil shape, and a step (A2) of subjecting the shaped titanium alloy part to an aging treatment.

In a preferred embodiment, step (B) includes shooting the first shot medium against the shaped titanium alloy part via centrifugal force, compressed air, or hydraulic pressure.

A titanium alloy part according to a preferred embodiment of the present invention hardly includes any modified layer in which defects which could serve as starting points of destruction exist, and a compressive stress exists in the area of the surface of the titanium alloy part. As a result, the titanium alloy part of a preferred embodiment of the present invention exhibits a high fatigue strength.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1A:
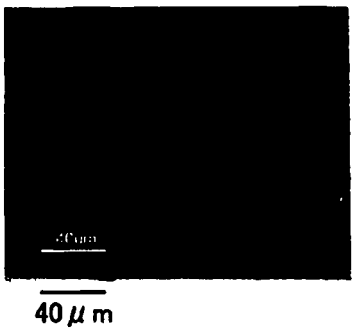
FIGS. 1A and 1B are photographs showing, respectively, a cross-sectional structure of a steel spring and a cross-sectional structure of a conventional titanium alloy spring.
Figure 1B:
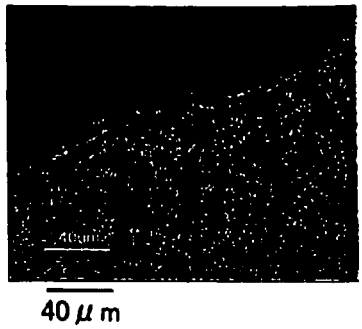

In order to ascertain the reason why a sufficient fatigue strength cannot be obtained even if the conventionally-practiced shot peening is performed for a titanium alloy spring, the inventors have examined cross sections of titanium alloy springs. FIG. 1A is a photograph showing a cross section of a steel spring. FIG. 1B is a photograph showing a cross section of a titanium alloy spring. Both springs have been subjected to a conventional shot peening treatment for obtaining an improved fatigue strength.

As can be seen from a comparison between FIGS. 1A and 1B, the area of the surface of the titanium alloy spring includes a region in which defects which are not observed in the steel spring exist. As a result of a detailed study of the cross section of the titanium alloy spring, the inventors have obtained the following information.

Figure 2A:
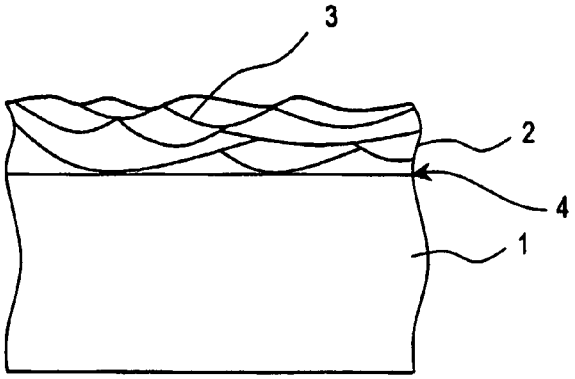
FIG. 2A is a schematic diagram illustrating a cross-sectional structure of a conventional titanium alloy spring.

FIG. 2A schematically shows a cross section of the titanium alloy spring shown in FIG. 1B. From a detailed analysis and study of the cross section, the inventors realized that a modified layer 2 which includes defects 3 is formed in the area of the surface of the titanium alloy spring which has been subjected to a shot peening.

A titanium alloy has a hexagonal close-packed (HCP) structure at room temperature. However, when the titanium alloy is placed within an environment that is at a temperature of 885° C. or more, or if the titanium alloy includes Mo, V, Nb, Ta, and the like as alloying elements, the titanium alloy has a body-centered cubic (BCC) structure. The HCP structure and the BCC structure are also referred to as the $\alpha$ phase and the $\beta$ phase, respectively. An alloy which takes a BCC structure at room temperature is called a $\beta$ alloy. Since the $\beta$ phase generally offers good processibility, titanium alloy springs are generally composed of a $\beta$ alloy.

In the case where a shot medium is shot against the surface of a titanium alloy spring, the kinetic energy of the shot medium is consumed when dents are formed on the spring surface, or consumed during heating of the spring surface. The inventors' analysis has shown that, due to the energy (deformation and heat) applied through the shot peening, the $\beta$ phase has transitioned to the $\alpha$ phase in the modified layer 2, so that most of the resultant modified layer 2 is constituted by the $\alpha$ phase, i.e., the HCP structure. The modified layer 2 has a thickness of about 20 μm to about 40 μm. A region 1 which is located farther inward in the modified layer 2 is not affected by the heat, and therefore is constituted by the $\beta$ phase or an alloy which abounds in the $\beta$ phase. In other words, the modified layer 2 contains more $\alpha$ phase than does the region 1.

Figure 2B:
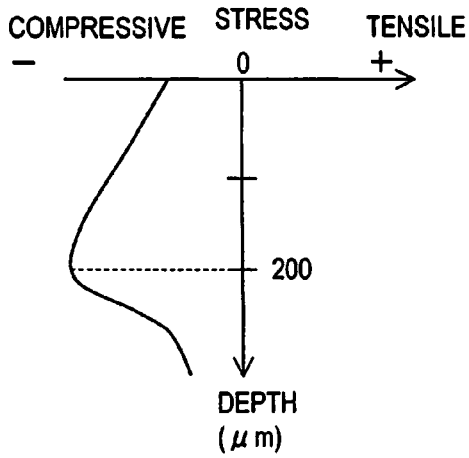
FIG. 2B shows a stress distribution along the depth direction.

FIG. 2B schematically shows a profile (along the depth direction) of internal residual stress in the cross section shown in FIG. 2A. As seen from FIG. 2B, the modified layer 2 is formed on the surface, and the residual compressive stress increases towards deeper portions of the spring. The compressive stress is greatest at the internal region 1 (about 200 μm) of the modified layer.

A fatigue test was performed for the titanium alloy spring shown in FIG. 1B, which showed a reduced fatigue strength. The presumable reason is that, since the defects 3 occurring in the modified layer 2 have reached an interface 4 between the modified layer 2 and the region 1 in which the aforementioned transition has not occurred, stress concentrates on the interface 4, whereby rupture expands into the region 1 beginning from the interface 4.

The above-described information has led to the inventive concept that, by removing the modified layer 2, defects 3 that might serve as starting points of rupture can be removed, and yet a region 1 having a relatively large residual compressive stress can be provided in the area of the surface. As a result, the fatigue strength of the titanium alloy spring will be improved by taking advantage of the compressive stress of the area of the spring surface.

Hereinafter, a titanium alloy part according to preferred embodiments of the present invention and a method for producing the same will be specifically described.

Figure 3A:
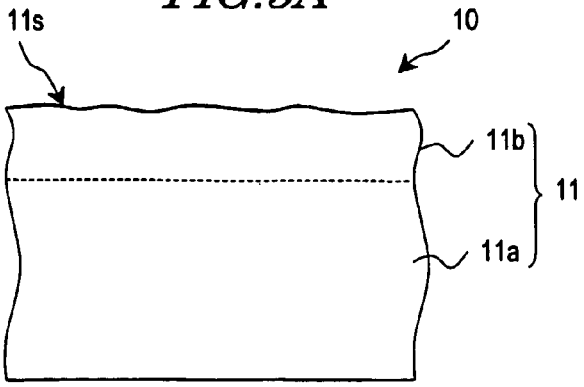
FIG. 3A is a schematic diagram illustrating a cross-sectional structure of a titanium alloy spring according to the present invention.
Figure 3B:
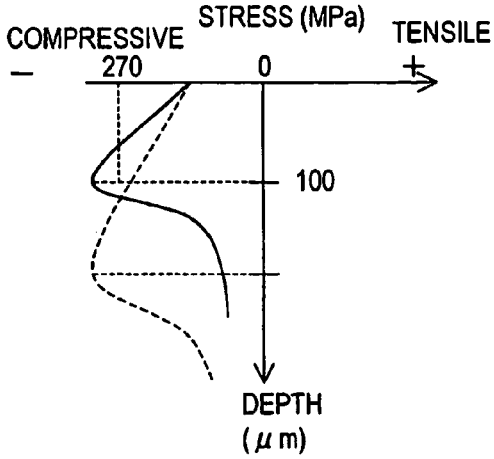
FIG. 3B show a stress distribution along the depth direction.

FIG. 3A schematically shows the cross-sectional structure in the area of the surface of a titanium alloy part according to a preferred embodiment of the present invention. FIG. 3B shows a residual stress profile (along the depth direction) of the structure shown in FIG. 3A. The titanium alloy part 10 includes a surface region 11*b* and an internal region 11*a* located internally relative to the surface region 11*b*. The surface region 11*b* is a region within a depth of about 100 μm from a surface 11*s* of the titanium alloy part 10, and has a compressive stress of approximately 270 MPa or more. As will be described in more detail below, this compressive stress is a result of a shot peening treatment. A modified layer which emerged on the surface through the shot peening has been removed from the titanium alloy part 10.

Through detailed studies, the inventors have experimentally confirmed that the titanium alloy part 10 acquires an improved fatigue strength based on the presence of a compressive stress of approximately 270 MPa or more in a region at a depth no more than about 100 μm from the surface 11*s* of the titanium alloy part 10 (i.e., the surface region 11*b*). However, when taking the yield point of the titanium alloy part 10 into consideration, it is preferable that the compressive stress is about 1,100 MPa or less. As used herein, "stress" refers to a residual stress with respect to the β phase of the titanium alloy part 10, as measured by an X-ray technique using a V tube. However, a stress value as measured by an X-ray technique does not coincide with a value as measured by a strain gauge technique, which is a commonly-used stress measurement technique. Therefore, each stress value as measured by an X-ray technique is certified by using a strain gauge technique, and the stress value as measured by the X-ray technique is corrected based on the certification.

The profile of FIG. 2B is also shown in FIG. 3B by broken line. As can be seen from FIG. 3B, as compared to the stress peak obtained by a conventional shot peening, the stress peak of the structure shown in FIG. 3A is shifted toward the area of the surface, the compressive stress being greatest at a depth of about 100 μm. The compressive stress profile obtained with a shot peening depends on the mass and shooting speed of the shot medium used. In general, a heavy shot medium must be used to obtain a large compressive stress, and such a shot medium will have a large energy when colliding with the target object. Therefore, the energy associated with the shot medium will be propagated deep inside the target object, thus resulting in a stress peak which is at a deep position. In other words, when a shot peening is performed a single time under conditions for generating a large compressive stress, the maximum stress value will occur at a relatively deep position from the surface, and it will be difficult to obtain a large stress in a relatively shallow region from the surface as in preferred embodiments of the present invention.

It should be noted that the surface region 11*b*, which refers to the region at a depth no more than about 100 μm from the surface 11*s* of the titanium alloy part 10, is only distinguishable in the context of defining the compressive stress in the area of the surface. In other words, there is no actual distinction in composition or physical properties between the surface region 11*b* and the internal region 11*a*. In the example shown in FIG. 3B, the compressive stress is largest near the boundary between the surface region 11*b* and the internal region 11*a*; the stress drastically decreases in a region which is deeper into the internal region 11*a* than the boundary; thereafter, the stress has a substantially constant value.

It is preferable that the entirety 11 (including the surface region 11*b* and the internal region 11*a*) of the titanium alloy part 10 contains approximately 50 vol % or more of the β phase. In fact, the entirety 11 of the titanium alloy part 10 may altogether be composed of the β phase. In other words, the titanium alloy part 10 may be composed of an α+β alloy containing approximately 50 vol % or more of the β phase, or composed of a β alloy. Such an alloy preferably contains at least one or more element selected from among Al, Fe, Mo, Sn, V, Zr, Si, Cr, Nb, O, and the like. Typical exemplary compositions include: Ti-1.5Al-4.5Fe-6.8Mo-0.15O; Ti-13V-11Cr-3Al; Ti-8Mo-8V-2Fe-3Al; Ti-3Al-8V-6Cr-4Mo-4Zr; Ti-11.5Mo-6Zr-4.5Sn; Ti-15Mo-5Zr; and Ti-15Mo-5Zr-3Al.

As mentioned earlier, it is preferable that the modified layer emerging from the shot peening treatment is removed so that the surface region 11*b* contains no modified layer at all. Note however that, when a modified layer remains in the surface region 11*a* at a proportion of about 10 vol % or less, the defects 3 which are a cause of stress concentration are almost entirely eliminated from the titanium alloy part 10, whereby the titanium alloy part 10 acquires a high fatigue strength.

It is preferable that the surface 11*s* of the titanium alloy part 10 has a maximum surface roughness Rt of about 20 μm or less. By making the surface 11*s* smooth, the stress concentration on the surface 11*s* can be alleviated, thus preventing the rupturing of the titanium alloy part 10 due to fatigue. In particular, if the surface 11*s* includes even a single rough portion, stress will concentrate in that portion. Therefore, by prescribing the aforementioned range of maximum surface roughness, a further prevention and minimization of stress concentration can be expected in addition to removing the modified layer.

Next, with reference to FIG. 4 and FIGS. 5A, 5B, and 5C, an example of a method for producing a titanium alloy part according to a preferred embodiment of the present invention will be described. In the following description, a method for producing a titanium alloy spring will be described.

First, a wire material for constructing a spring is prepared (step 21). In advance, the wire material is subjected to a cold wiredrawing process or the like so as to have a desired diameter. As the wire material, among those titanium alloy materials mentioned above, a β alloy or an α+β alloy having relatively a little α phase component is preferably used for good processibility. The prepared wire material is processed into a desired shape by a shaping method such as a coiling process (i.e., wound around), whereby a shaped titanium alloy part, which in this case is a shaped spring, is obtained (step 22). Thereafter, the shaped spring is subjected to an aging treatment (step 23).

Figure 5A:
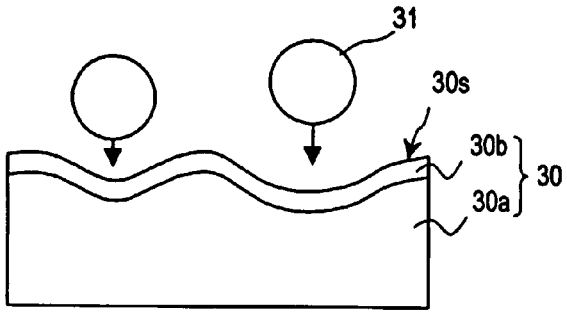
FIGS. 5A, 5B, and 5C are cross-sectional views showing steps in a method for producing a titanium alloy spring.

Next, a shot peening treatment for generating a compressive stress in the area of the surface of the shaped spring is performed (step 24). As shown in FIG. 5A, a shot medium 31 is shot against a surface 30*s* of the spring 30, thus forming dents in the surface 30*s*. As the shot medium 31, cast steel shot balls or cut wires are preferably used from the cost perspective. The size of the shot medium 31, the shooting speed, and the shooting density are appropriately selected in accordance with the size of the titanium alloy part to be produced, the purpose for which the titanium alloy part will be used, and the composition of the alloy which forms the titanium alloy part. The shot medium can be shot by utilizing centrifugal force, compressed air, hydraulic pressure, or any other known method. As shown in FIG. 5A, through the shot peening treatment, a modified layer 30*b* which contains more a phase than in an internal region 30*a* and therefore includes defects is formed in the area of the surface 30*s* of the spring 30. From this shot peening treatment, a compressive stress is generated in the modified layer 30*b* and the internal region 30*a*. The shot peening treatment may be repeated in a plurality of instances while varying the aforementioned condition, so that the titanium alloy part will have an optimum compressive stress profile along the depth direction in accordance with an intended purpose. Generally speaking, a compressive stress at a position deep inside the titanium alloy part can be generated by performing a shot peening treatment using a large shot medium 31.

Figure 4:
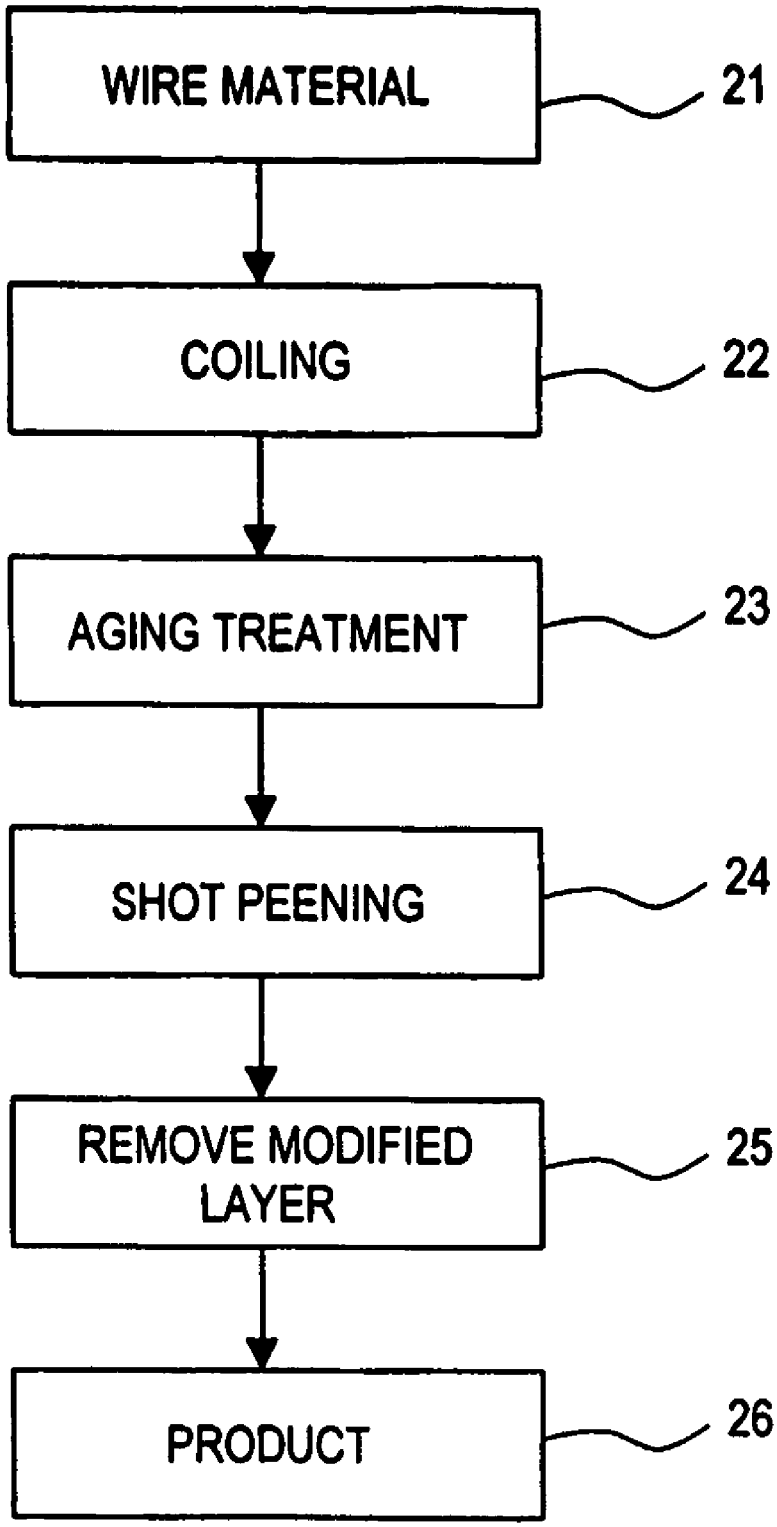
FIG. 4 is a flowchart showing a method for producing a titanium alloy spring.

Next, the modified layer 30*b* is removed (step 25 in FIG. 4). When removing the modified layer 30*b*, it is preferable to remove the modified layer 30*b* while applying a further compressive stress to the internal region 30*a*. It is also preferable that the spring 30 has a reduced surface roughness after the removal of the modified layer 30*b*. As long as these conditions are satisfied, the removal of the modified layer 30*b* may be performed by any method. However, in order to remove the modified layer 30*b* while applying a compressive stress, it would be preferable to perform the removal of the modified layer 30*b* in a mechanical or physical manner.

In the case where the modified layer 30*b* is mechanically removed, it is preferable to remove the modified layer 30*b* by performing a shot peening using a shot medium which has a small grain size. Since a titanium alloy generally has a Vickers hardness of about 370 to about 470, it is preferable to use a shot medium which has a higher hardness than these values and provides good abrasive ability. For example, it is preferable to use an $SiO_2$ shot medium having a specific gravity of about 2.5, a Vickers hardness of about 1,000, and an average grain size of about 50 μm or less. Due to the small grain size and the small specific gravity, such a shot medium does not apply a large energy at collision. Therefore, the shot medium will not form any new dents in the surface of the spring 30 by being shot, but is capable of applying a certain level of stress to the internal region 30*a* at collision. Moreover, an $SiO_2$ shot medium is considered to have a high abrasive ability because of having a high hardness in spite of its spherical shape. On the other hand, the shot medium (e.g., cast steel) which is used in the first shot peening has a lower hardness than that of a shot medium composed of $SiO_2$. Therefore, during the shot peening, the titanium alloy part only undergoes plastic deformation, and hardly any abrasion of the modified layer 30*b* and the internal region 30*a* occurs.

Figure 5B:
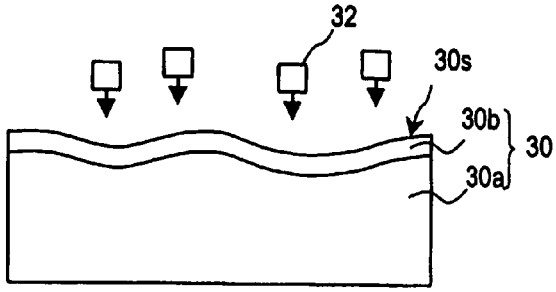
Figure 5C:
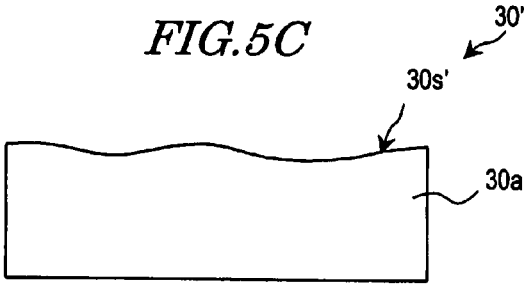

As shown in FIG. 5B, the modified layer 30*b* is removed by shooting the $SiO_2$ shot medium 32 against the spring 30. At this time, the modified layer 30*b* is completely removed, and furthermore, the internal region 30*a* may also be partially removed. A part of the modified layer 30*b* may be left as long as the proportion of the modified layer 30*b* in the surface region at a predetermined depth from the surface is equal to or less than the aforementioned range. Any large protrusion on the surface 30*s* of the spring 30 is selectively bombarded with the shot medium 32, and thus is abraded. As a result, the surface roughness of the surface 30*s* is reduced. Thus, as shown in FIG. 5C, the modified layer 30*b* is removed, and a spring 30' having the internal region 30*a* exposed on whose surface 30*s*' is obtained (step 26 in FIG. 4).

From the titanium alloy spring produced in this manner, a modified layer containing defects which might serve as starting points of destruction has been removed, so that a compressive stress exists in the area of the spring surface. Since the spring surface has a small surface roughness, stress concentration is alleviated. As a result, the titanium alloy spring exhibits a high fatigue strength.

The above-described preferred embodiments illustrate the titanium alloy part of the present invention as a spring. A titanium alloy spring according to preferred embodiments of the present invention can be suitably used as a suspension spring for a vehicle, e.g., a two-wheeled vehicle or a four-wheeled vehicle. Moreover, the titanium alloy spring of preferred embodiments of the present invention is also suitable as a valve spring for an engine. Due to its excellent fatigue strength, a titanium alloy part according to preferred embodiments of the present invention is also suitably used for any elastic part or structural part, other than a spring, which is subjected to repetitive stress. For example, a titanium alloy part according to preferred embodiments of the present invention is also suitably used as a connecting rod for connecting a piston and a crankshaft of an engine, an engine valve, or a structural part for aircraft.

Hereinafter, some evaluation results of the characteristics of a titanium alloy part which was produced according to preferred embodiments of the present invention will be described. In the example below, a suspension spring (coil diameter: about 100 mm; height: about 150 mm) for a two-wheeled vehicle was produced from a wire (diameter: about 12 mm) which was composed of a titanium alloy whose composition was Ti-1.5Al-4.5Fe-6.8Mo-0.15O.

After subjecting this spring to an aging treatment at 520° C. for 3 hours, a shot peening treatment and a removal of the modified layer were performed under the following conditions. As a comparative example, a spring was produced through a similar procedure, but was only subjected to a shot peening treatment. In the present example of the invention, the shot peening treatment is performed twice, by using a different shot medium each time, in order to apply an internal stress in a more uniform manner.

TABLE 1

| | Treatment | Conditions |
|---|---|---|
| Present Invention | shot peening | #1 cut wires: ϕ 0.8 mm; shooting speed: 45 m/s; treatment time: 90 s<br>#2 steel: ϕ 0.3 mm; shooting speed: 50 m/s; treatment time: 60 s |
| | removal of modified layer | $SiO_2$ shot: ϕ 0.05 mm; shooting method: centrifugal 0.5 mmA; treatment time: 60 s |
| Comparative Example | shot peening | cut wires: ϕ 0.8 mm; shooting speed: 45 m/s; treatment time: 90 s |
| | removal of modified layer | — |

Figure 6A:
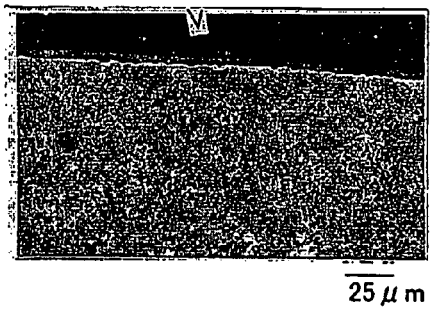
FIGS. 6A and 6B are photographs showing, respectively, a cross-sectional structure of a titanium alloy spring according to a preferred embodiment of the present invention and a titanium alloy spring of Comparative Example.
Figure 6B:
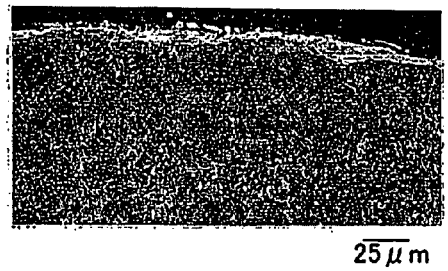

FIGS. 6A and 6B are photographs showing, respectively, a cross-sectional structure of the spring according to a preferred embodiment of the present invention and the spring of Comparative Example. As seen from FIG. 6A, the spring according to preferred embodiments of the present invention has a uniform structure from the surface into its interior. On the other hand, it can be seen from FIG. 6B that the spring of Comparative Example has a modified layer (including a multitude of defects) formed in the area of the surface. Moreover, the surface of the spring of the present invention has a smaller surface roughness than that of the spring of Comparative Example.

Figure 7:
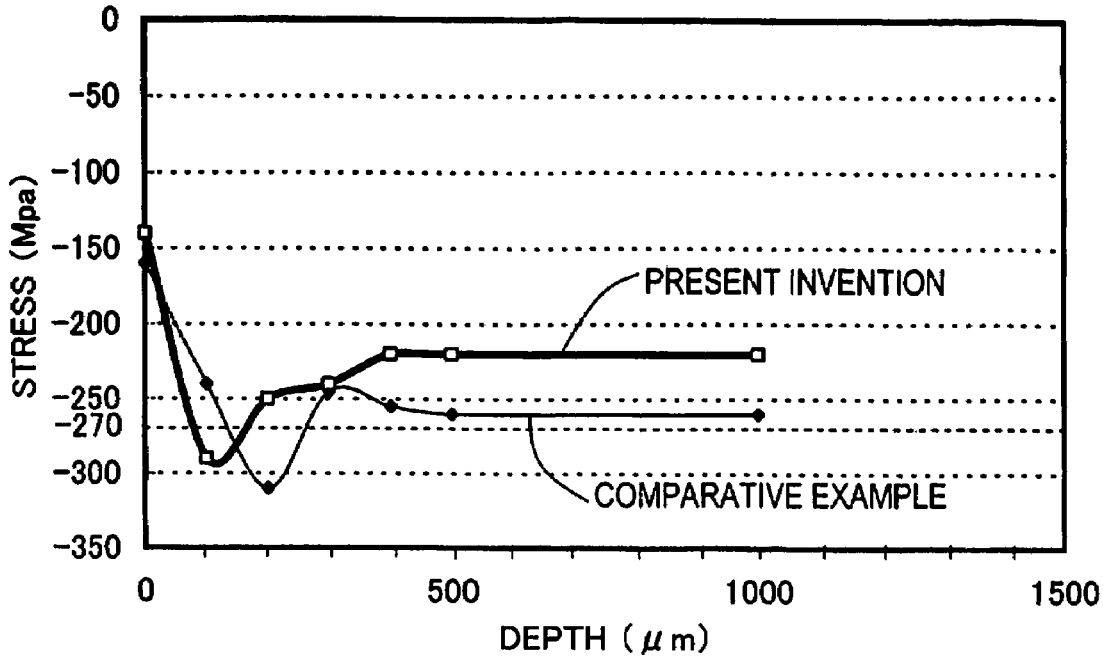
FIG. 7 is a graph showing a stress distribution along the depth direction of a titanium alloy spring according to a preferred embodiment of the present invention and a titanium alloy spring of a Comparative Example.

FIG. 7 is a graph showing results of stress measurements (along the depth direction) performed for the spring of the present invention and the spring of Comparative Example. The stress values were obtained by measuring a residual stress of the β phase by an X-ray technique using a V tube. As a measurement apparatus, an X-ray stress measurement apparatus (PSPC-MSF; available from Rigaku Denki) was used.

As described earlier, the measurement values have been subjected to correction by using a strain gauge technique.

As seen from FIG. 7, a compressive stress exists in the interior of the spring of preferred embodiments of the present invention, with a drastic profile beginning from the surface thereof, such that a compressive stress of about 290 MPa exits at a depth of about 100 μm from the surface. At deeper positions, the compressive stress is gradually alleviated, and a constant value of 220 MPa is maintained in any region deeper than about 400 μm, which is presumably due to a deposition stress of the α phase.

On the other hand, in Comparative Example, a gradually compressive stress occurs from the surface, such that a compressive stress of about 310 MPa exists at a depth of about 200 μm. At deeper positions, the compressive stress is gradually alleviated, and a constant value of approximately 260 MPa is maintained in any region deeper than about 400 μm.

As seen from FIG. 7, in the area of the surface, a greater compressive stress exists in the spring of preferred embodiments of the present invention than in the spring of Comparative Example.

Figure 8:
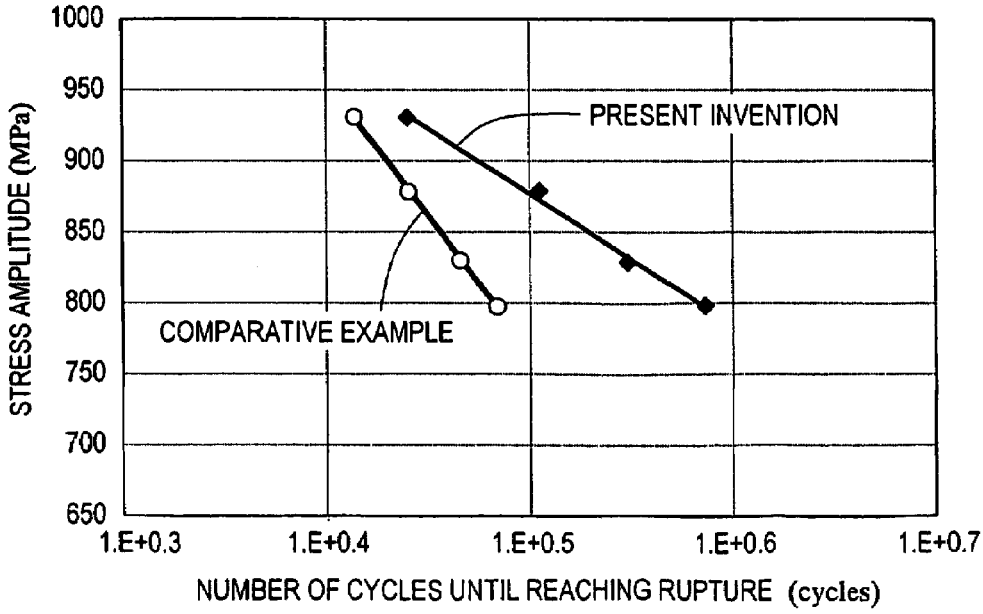
FIG. 8 is a graph showing results of rotating bending fatigue tests for a titanium alloy spring according to a preferred embodiment of the present invention and a titanium alloy spring of a Comparative Example.

FIG. 8 shows results of rotating bending fatigue tests performed for the spring of preferred embodiments of the present invention and the spring of the Comparative Example. As seen from FIG. 8, the spring of preferred embodiments of the present invention requires about 10 times as many repetitive cycles until reaching rupture than the spring of Comparative Example, thus indicating an improved fatigue strength.

Thus, as compared to the spring of the Comparative Example, the spring of preferred embodiments of the present invention is characterized in that the modified layer is substantially completely removed so that the surface is free of defects; the spring surface has a small surface roughness; and a compressive stress exists with a drastic profile beginning from the surface thereof. Such characteristics presumably contribute to the improved fatigue strength.

Table 2 shows results of durability evaluation tests which were performed while varying the maximum compressive stress within a depth of about 100 μm from the surface. As seen from Table 2, excellent durability is obtained by introducing a compressive stress of approximately 270 MPa or more within a depth of about 100 μm from the surface.

TABLE 2

| maximum compressive stress within a depth of about 100 μm from surface (Mpa) | 160 | 240 | 260 | 270 | 290 | 300 |
|---|---|---|---|---|---|---|
| durability evaluation result | X | X | X | ○ | ○ | ○ |

○: good
X: bad

Figure 9:
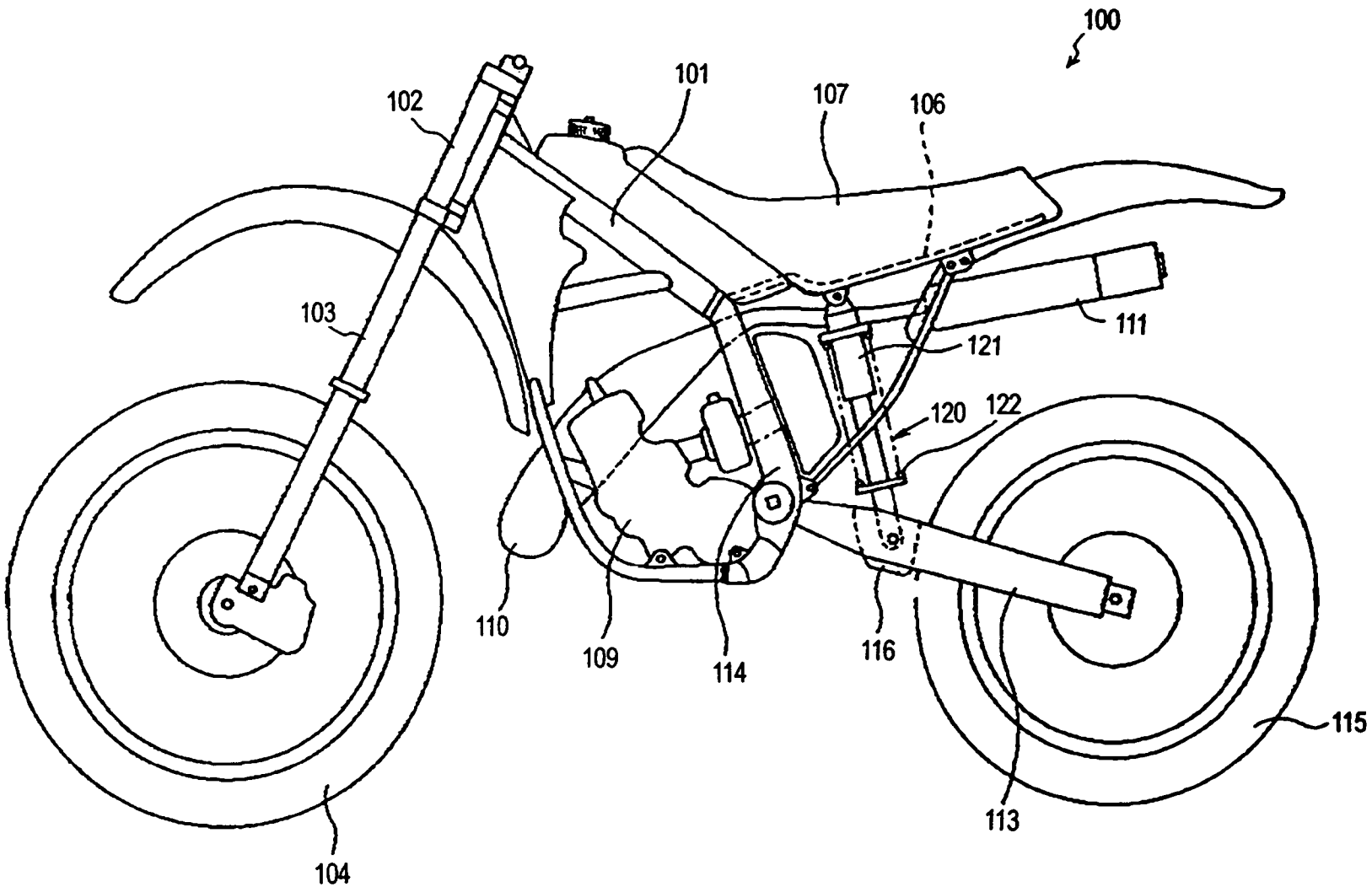
FIG. 9 is a side view schematically showing a motorcycle including a titanium alloy spring according to a preferred embodiment of the present invention.

FIG. 9 shows a motorcycle 100 which includes a titanium alloy spring according to a preferred embodiment of the present invention as a suspension spring.

The motorcycle 100 includes a head pipe 102 attached to the front end of the body frame 101. To the head pipe 102, a front fork 103 is attached so as to be capable of swinging in the right-left direction of the vehicle. At the lower end of the front fork 103, a front wheel 104 is supported so as to be capable of rotating.

A seat rail 106 is attached at an upper portion of the rear end of the body frame 101 so as to extend in the rear direction. A seat 107 is provided on the seat rail 106.

At a central portion of the body frame 101, an engine (internal combustion engine) 109 is held. An exhaust pipe 110 is connected to an exhaust port of the engine 109, and a muffler 111 is attached to the rear end of the exhaust pipe 110.

A pair of rear arms 113 extending in the rear direction are attached to the rear end of the body frame 101. The rear arms 113 are pivoted by a seat pillar 114. At the rear end of the rear arms 113, a rear wheel 115 is supported so as to be capable of rotating.

The rear arm 113 which is provided on the left side of the motorcycle 100 and the rear arm (not shown) which is provided on the right side of the motorcycle 100 are connected to each other via a connection part 116 extending along the width direction of the vehicle.

The connection part 116 is linked to the seat rail 106 via a shock absorber 120, such that the rear arms 113 and the rear wheel 115 are suspended from the body via the shock absorber 120.

Figure 10:
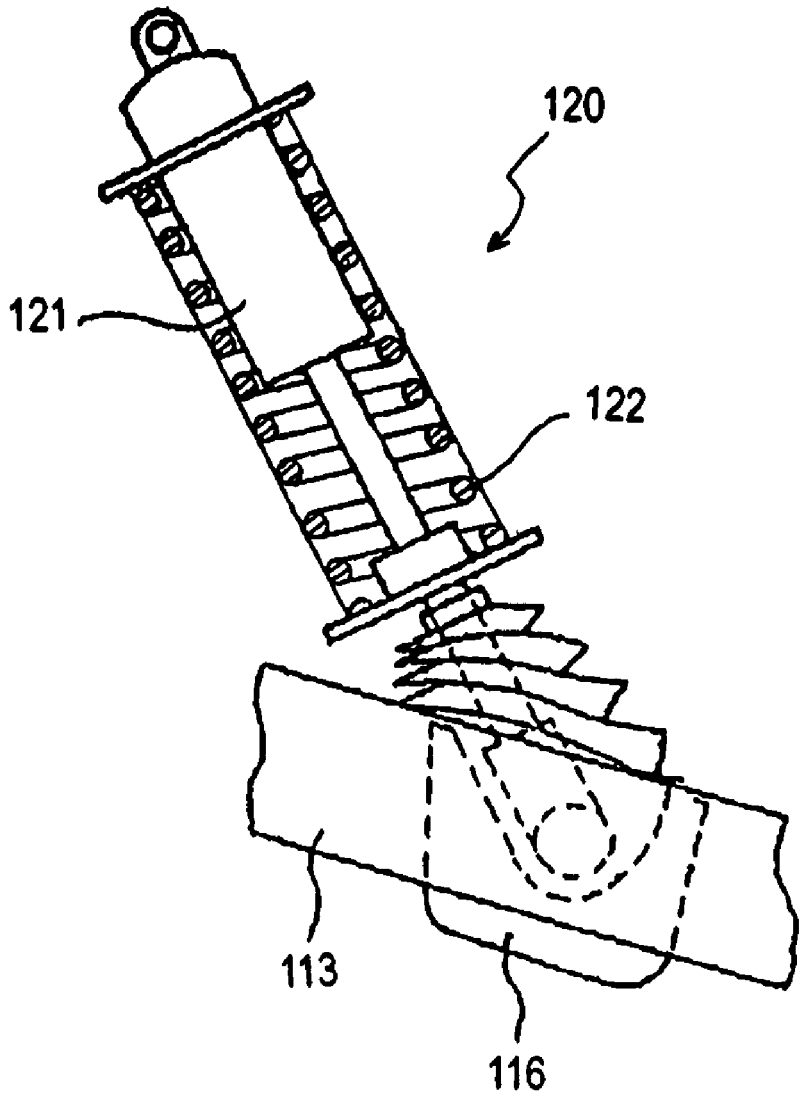
FIG. 10 is an enlarged view of a shock absorber of the motorcycle shown in FIG. 9.

FIG. 10 shows an enlarged view of the shock absorber 120. The shock absorber 120 includes a hydraulic cylinder 121, and a spring 122 which is fitted onto the cylinder 121. The shock absorber 120 including the spring 122 dampens the shock and vibration transmitted from the rear wheel 115.

The motorcycle 100 can attain preferable performance because of incorporating a titanium alloy spring according to preferred embodiments of the present invention, which provides excellent fatigue strength, as the spring 122 of the shock absorber 120.

The illustrated motorcycle 100 incorporates a titanium alloy spring according to preferred embodiments of the present invention as a suspension spring. Alternatively, the titanium alloy spring according to preferred embodiments of the present invention can be implemented as a valve spring for an engine to also provide preferable performance. Alternatively, the titanium alloy part according to preferred embodiments of the present invention may be implemented as a connecting rod for an engine to also provide preferable performance. The suspension spring, the valve spring for an engine, the connecting rod, e.g., as such may be collectively referred to as "parts for an internal combustion engine".

A titanium alloy part according to preferred embodiments of the present invention and a method for producing the same can be applied to various fields, such as elastic parts (e.g., springs) and structural parts in general. In particular, the titanium alloy part according to preferred embodiments of the present invention is light in weight and yet has a high strength and high durability, and therefore can be suitably used in fields such as transportation apparatuses (e.g., vehicles and aircraft), and architecture.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

While the present invention has been described with respect to preferred embodiments thereof, it will be apparent to those skilled in the art that the disclosed invention may modified in numerous ways and may assume many preferred embodiments other those specifically set out and described above. Accordingly, it is intended by the appended claims to cover all modifications of the present invention which fall within the true spirit and scope of the present invention.

The invention claimed is:

1. A titanium alloy part having a compressive stress of approximately 270 MPa or more within a depth of about 100 μm from a surface thereof; wherein a surface region extends from the surface to a depth of about 100 μm, and an internal region is disposed internally relative to the surface region; and the surface region includes a modified layer containing more a phase than does the internal region, the modified layer accounting for a proportion of about 10 vol % or less of the surface region.

2. The titanium alloy part of claim 1, wherein the surface has a maximum surface roughness Rt of about 20 μm or less.

3. The titanium alloy part of claim 1, wherein the titanium alloy part contains about 50 vol % or more of β phase at room temperature.

4. The titanium alloy part of claim 1, wherein the titanium alloy part is a spring.

5. The titanium alloy part of claim 1, wherein the titanium alloy part is a suspension spring for a vehicle.

6. The titanium alloy part of claim 1, wherein the titanium alloy part is one selected from the group consisting of a valve spring for an engine, a connecting rod for an engine, and a structural part for an aircraft.

7. An engine comprising the titanium alloy part of claim 1.

8. A vehicle comprising the titanium alloy part of claim 1.

* * * * *